United States Patent [19]

Edwards

[11] 3,967,474

[45] July 6, 1976

[54] APPARATUS AND METHOD FOR MANUFACTURING LEATHER BEADING LINE AND THE NOVEL PRODUCT MADE THEREBY

[76] Inventor: Hans Alexander Edwards, 2118 3rd St., Santa Monica, Calif. 90405

[22] Filed: May 19, 1975

[21] Appl. No.: 578,407

[52] U.S. Cl. ..... 69/21; 69/6

[51] Int. Cl.[2] ..... C14B 5/00

[58] Field of Search ..... 69/6, 21

[56] References Cited

UNITED STATES PATENTS

| | | | |
|---|---|---|---|
| 39,335 | 7/1863 | Beckman | 69/6 |
| 115,949 | 6/1871 | Foster | 69/6 |
| 133,274 | 11/1872 | Webber | 69/6 |
| 150,704 | 5/1874 | Osborne | 69/6 |
| 299,116 | 5/1884 | Dean | 69/6 |
| 899,860 | 9/1908 | Coleman | 69/6 |
| 1,391,302 | 9/1921 | Czaran | 69/21 |
| 2,319,018 | 4/1943 | Plummer | 69/21 X |

*Primary Examiner*—Alfred R. Guest
*Attorney, Agent, or Firm*—Bruce L. Birchard

[57] ABSTRACT

Beginning with leather lacing of substantially rectangular cross-section, moistening that lacing to a proper degree, drawing the moistened lacing through one or more shaping dies under controlled tension, drying the formed lacing and then applying an emollient in a controlled amount, a leather beading line of high strength, pliability and ease of threading and with substantially circular cross-section is obtained.

14 Claims, 3 Drawing Figures

APPARATUS AND METHOD FOR MANUFACTURING LEATHER BEADING LINE AND THE NOVEL PRODUCT MADE THEREBY

BACKGROUND OF THE INVENTION

1. Field of the Invention

This invention relates to leather products and more specifically to leather beading line for use in such applications as stringing beads or necklaces.

2. Prior Art

The art of leather shaping has been relatively dormant for the past half century, as is evident from a search of the patent art related to that subject. In that earlier era the end use of the leather products was related to harnesses and other horse gear. The thickness of the material being treated and the thickness or diameter of the resultant product was great relative to the diameter of the end product contemplated here. As a result, ridges and other imperfections in the surface could be tolerated in the products of the prior era while still permitting the intended end use of the product. The primary techniques utilized to obtain desired cross-sectional shapes were cutting, rolling and drawing. Examples of such techniques are set forth in U.S. Pat. Nos. 115,949 (Foster) and 899,860 (Coleman). Other U.S. Pats. such as No. 162,762 (Osborne) and No. 950,096 (Driscoll) show the use of split, leather-forming dies.

Beginning with flat lace of substantially rectangular cross-section, there is no way of obtaining the desired product by cutting. Cutting is appropriate only if the starting material is of substantially square cross-section. Such material might be obtained by cutting the lace from thicker and older hides. However, older hides are more porous, grainy and weaker than the younger, thinner calf hides, and are therefore not suitable for obtaining the product according to the present invention. Moreover, cutting produces a waste material which is not created with my invention since my invention, like the process of rolling, involves not the taking away of material but rather the reshaping of it. Indeed, if the aforementioned calf lace were to be cut, say to conform in width to the diameter of the beading line of this invention the resulting line would still be unlike the beading line of this invention in that the cut line would remain consistently flat and, moreover, would be weakened by the loss of material. Finally, any analogous product obtained from older cow hides by a process of cutting would have the additional disadvantages of exhibiting a relatively rough external surface texture and would be either extremely weak in tensile strength or else would be of much greater diameter than the product of my invention, or both. A larger diameter severely restricts the use of such materials in bead stringing, whereas our product can be used with a great variety of bead sizes, and bead stringing is the primary intended use of my claimed end product.

Further, the various methods of rolling leather round are unacceptable because either they limit the length of the leather strips that are obtainable, or they require as starting material leather strips of substantially square cross section, or both. They may also be incapable of producing leather string with a diameter as small as is contemplated here. For even with the method in which the starting material is rolled through an orifice created between the appropriately shaped surfaces of two rollers, and even if one of these rollers is fitted with suitable flanges extending into the indentation of the second roller so as to keep the material being rolled from spreading laterally between the flat and contiguous surfaces of the rollers, there exists a problem, namely, the formation of a longitudinal ridge or "flashing" along the length of the finished product. While such flashing is not objectionable where the product itself is large in diameter, as in harnesses, it is objectionable in smaller-diameter products, such as the beading line contemplated here, which line may have a final diameter of only about 3/64 inch. Furthermore, the layered material may catch in the joint between the two rollers whereupon there is great risk of the material's being cut by the flanges of one roller pressing against the walls of the other roller, and therefore, there is a great danger of leather rupture and breakage. Also, there is a lack of uniform pressure around the material, a problem not faced with a closed-die drawing process.

Similar difficulties arise in drawing the lace through split dues, a method that, historically, was rejected in favor of the method involving rollers. Here, too, there is the aformentioned flashing, lack of uniform pressure and danger of breakage when the material catches in the joints of the split die. Breakage raises the cost of the end product because production time is lost and shortened lengths of saleable final product are obtained.

Therefore, it is a primary object of this invention to provide a process, apparatus for performing that process and the product of that process and apparatus, all of which are free from significant surface discontinuities.

It is a still further object of this invention to provide a process which produces from leather lacing which is rectangular in cross-section a thin, strong, pliable beading line which is small and consistent in diameter over its length.

It is an additional object of this invention to provide a leather beading line material which is smooth, circular in cross-section, strong and easily utilized in the stringing of beads for necklaces or the like.

SUMMARY OF THE INVENTION

Stated briefly, my invention include: the apparatus for and process of soaking a leather lace, preferably of calf's leather, in water, drawing the moistened lace with controlled tension through one or more closed dies each having a predetermined landing length and diameter, forced-air drying the formed lace, passing it through an emollient, removing the excess emollient from the beading line and spooling the resulting product for later use; and the beading line so formed.

BRIEF DESCRIPTION OF THE DRAWINGS

A better understanding of the present invention may be had from a consideration of the following detailed description, taken in conjunction with the accompanying drawings in which.

DESCRIPTION OF THE PREFERRED EMBODIMENT

Figures 1, 2, 3:
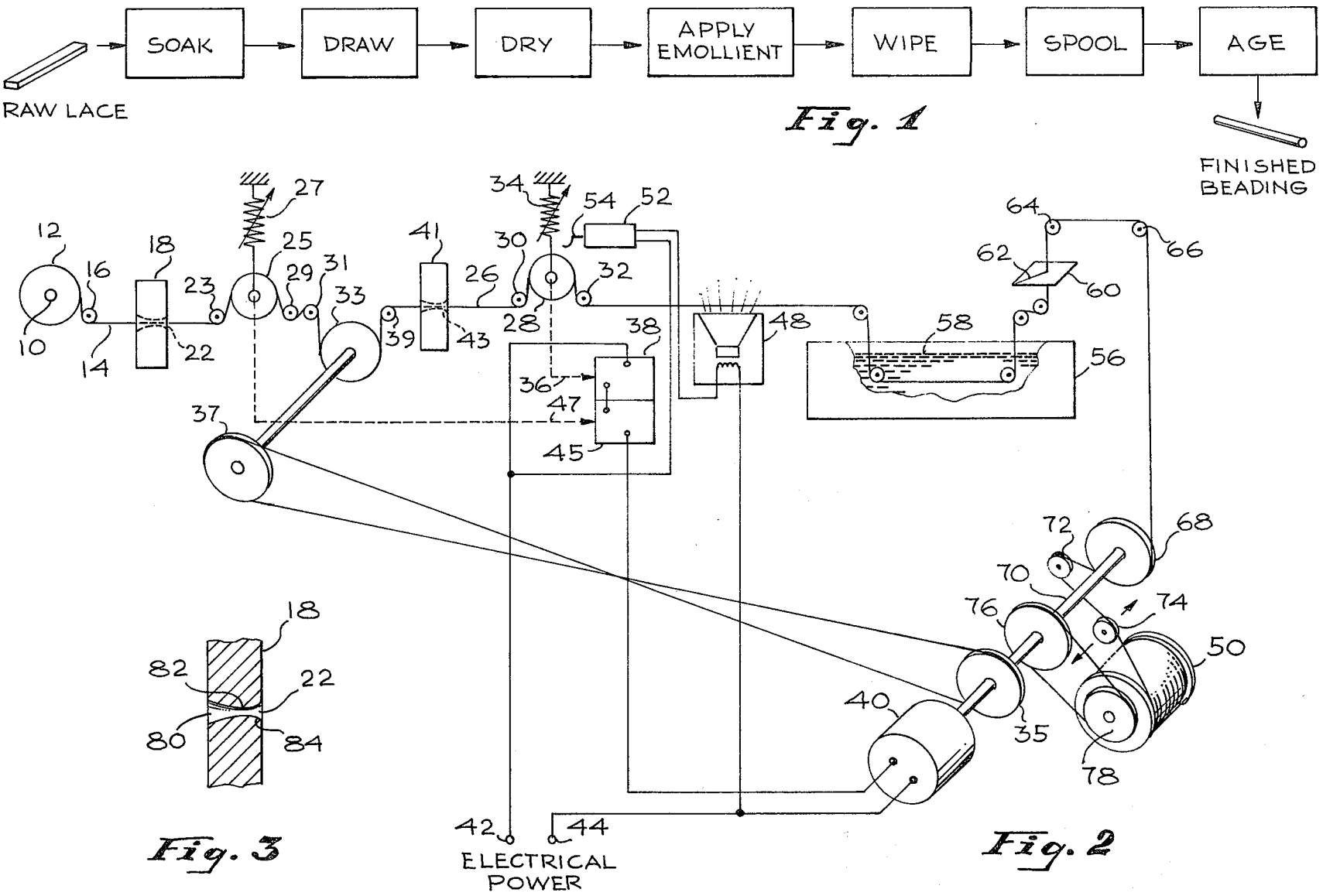
FIG. 1 is a flow-diagram showing the steps in one process according to my invention.
FIG. 2 is a schematic diagram of apparatus according to my invention.
FIG. 3 is a cross-sectional view of a portion of the apparatus of FIG. 2.

In FIG. 1, leather lacing, preferably derived from leather having a thickness of from 1/64 to 1/32 inch and having a width of approximately 3/32 to 1/8 inch is soaked, on its reel, if desired, in water or other compatible liquid at room temperature for about two hours. The purpose of the soaking is to remove brittleness in the lacing, thus increasing its pliability and capacity for its fibers to adopt new forms when coerced. The calf's leather lacing best used as the raw material in the process according to this invention is derived from the hides of English calves. Calf's leather from this region has proved to give the highest yield of usable beading line.

The reel is removed from its soaking bath and may, if desired, be put directly on the feed reel spindle of the forming apparatus of FIG. 2. The excess moisture on the outer surface of the reel of lacing may be permitted to dissipate by evaporation or run-off for about one-half hour before the forming machine is operated. The lace can be drawn up to 24 hours after soaking.

The moistened lace is then drawn through one or more forming dies. Certain of the dimensions of the forming die or dies are critical, as will be discussed in connection with FIG. 3. The tensioning of the lace during the drawing and other phases of the processing according to this invention must also be controlled so as not to exceed the tensile strength and the lace. Therefore, automatic tensioning control is also provided in the apparatus according to the present invention, as is set forth in connection with the description of FIG. 2.

After the drawing or forming process the formed beading line is dried. Accelerated drying may be achieved by means of, for example, a heater-blower. If such a drying device is used and is electrical in nature interlock means may be provided to interrupt current flow to the drying means when motion of the lacing through the apparatus stops for any reason, such interlock means preventing burning of the leather lace or beading line.

The purpose of drying the beading line before the succeeding emollient application step is to assure thorough impregnation of the beading line by the emollient. The emollient and any water retained by the beading line are, of course, immiscible.

The emollient may be, for example, linseed oil or some other natural oil. Animal oils such as neats foot oil, however, tend to render the final product too soft for beading and the leather string may tend to return to a more or less rectangular cross-section in use. A superficial excess of the emollient may exist on the beading as it emerges from the emollient application step and such excess is removed by a resilient wiper made of such a material as oil-resistant rubber, through a small aperture in which the beading line passes on its way to being spooled.

The finished beading line is spooled onto a reel to a desired length, say 100 yards.

The spool of beading line is permitted to stand for about one day to permit stabilization of the emollient-impregnated beading line and the result is a cosmetically attractive, pliable, circular cross-sectioned, smooth-surfaced, easily beaded leather beading line capable of passing easily through more varieties of beads than any other leather thong in existence.

In FIG. 2, spindle 10 carries feed reel 12 on which is wound leather lacing 14 cut, preferably, from English calfhide. Lacing 14 is rectangular in cross-section having a width dimension of about 3/32 to ⅛ inch with a thickness of about 1/64 inch. The lacing has been soaked in water at room temperature for a period of time (approximately two hours) to increase its pliability and to permit its being utilized in the apparatus of FIG. 2 with minimum breakage of the lacing during processing.

Idler roller 16 guides lace 14 into drawing die 18. Opening 22 in die 18 is circular in cross section and has a slowly tapered inlet opening, a sharply tapered outlet opening and a central landing portion, as can be seen more clearly in FIG. 3.

While a single shaping die such as die 18 may be used, for the best forming of leather lacing 14 with minimum breakage thereof multiple dies with decreasing diameters are desirable. However, a simple cascading of dies without intermediate driving and tension-controlling means will result in repeated breakage of lacing 14. Therefore, as can be seen from FIG. 2, after lacing 14 leaves die 18 it passes under guide roller 23, over tensioning roller 25 with tensioning spring 27, under and over guide rollers 29 and 31, respectively and under drive pulley 33 which is driven, in the correct direction for forward motion of lacing 14, from main drive motor 40 through pulleys 35 and 37. As lacing 14 (now partially formed into beading line) leaves drive pulley 33 it passes over guide roller 39 to a second drawing die 41 having opening 43, therein of the same general shape as opening 22 in die 18 but of lesser internal diameter. For example, commencing with lacing 14 having width 3/32 to ⅛ inch and with a desired beading line diameter of approximately 1/64 inch, die 18 may have a maximum inside diameter of 0.052 inch and die 41 a minimum inside diameter of 0.047 inch.

After emerging from die 41 lacing 14, originally of rectangular cross-section, has been transformed into beading line 26 of circular cross-section. Beading line 26 is guided over tensioning roller 28 by idler rollers 30 and 32. The tensioning roller 28 is biased upwardly by adjustable tensioning spring 34 to a point just below the breaking point of lacing 14 and beading line 26. This tensioning adjustment assures maximum speed of processing in the apparatus of FIG. 2.

Tensioning roller 28 is mechanically coupled to control arm or shaft 36 on drive-motor speed-controller 38, one of two series-connected speed controllers 38 and 45. Speed controller 38 controls the electrical power supplied to drive motor 40 in response to the displacement of tensioning roller 28 upwardly or downwardly. If roller 28 moves downwardly against the restoring force of spring 34 an increase in the tensile stress on lacing 14 and beading line 26 is indicated but such downward motion of roller 28 causes downward motion of control arm 36 and a reduction in the electrical power supplied to drive motor 40, with an attendant reduction in its speed and torque output and a reduction in the tension on lacing 14 and beading line 26. On the other hand, if the tension on beading line 26 is reduced, roller 28 will move upward increasing the power supplied to drive motor 40 and causing its output torque and shaft speed to rise, bringing the tensile stress on beading line 26 back to a predetermined level.

Similarly, speed controller 45 is automatically adjusted through arm 47 which is mechanically coupled to tensioning roller 25 for movement thereby. When the tensioning of lacing 14 is excessive in the region of roller 25, roller 25 moves downward causing downward motion of arm 47 and reduced electrical power supplied to motor 40. Thus if the tension in lacing 14 or beading line 26 is excessive after passing through die 18 or die 41, respectively, the speed of motor 40 will be reduced, lowering tension and preventing breakage of the leather lacing or beading line being processed. The exact nature of motor controllers 38 and 45 varies with the nature of drive motor 40. In the simplest case, drive motor 40 is a d.c. motor, the electrical power applied to terminals 42 and 44 is direct current and controllers 38 and 45 are rheostats with their sliding contacts mechanically coupled to control arms 36 and 47, respectively, and moved thereby so as to insert greater electrical resistance between power terminal 42 and motor terminal 46 when the tension in lacing 14 and beading line 26 exceeds a predetermined level. If drive motor 40 is an a.c. induction motor, controllers 38 and 45 may be of the S.C.R. type in which the portion of each half cycle of a.c. power which is passed along to motor 40 is determined by a pair of variable resistances driven by control arms 36 and 47, respectively, those resistances determining the firing point on each half-cycle of a.c. power at which point electrical power is allowed to pass to motor 40 from terminals 42 and 44. Motor speed controllers of this type are well known in the art and need not be explained in greater detail here.

After beading line 26 leaves guide roller 32 it passes over drier 48 which may combine an electrical heating element and a fan. The hot air temperatures achieved with such a device are quite high and will burn the leather beading line if that line stops moving while drier 48 continues to operate. Such a circumstance could arises if drier 48 continued to operate when drive motor 40 had no power applied to it or if beading line 26 broke beyond drier 48 in the direction of spool 50. To prevent the first recited problem, drier 48 is supplied power only if power is being supplied to the motor controllers 38 and 45, and the associated motor 40. The second problem is prevented by providing interlock switch 52 which is of a normally-closed variety and is in series with the power line to drier 48. If beading line 26 breaks beyond drier 48 the tension on roller 28 is removed, it moves upwardly under the force of spring 34 and hits activiating lever 54 of limit switch 52, thus breaking the electrical circuit to drier 48. A similar limit switch responding to a loss of tension in the lacing-beading line system can shut off motor 40.

After being dried, beading line 26 passes into emollient bath 56 where it is immersed in an oil or other emollient 58, such as linseed oil. When beading line 26 moves out of bath 56 it carries excess emollient on its surface. That excess is removed by wiper 60, which is of oil resistant, flexible material such as oil-resistant rubber. Wiper 60 has a slot 62 in it to receive beading line 26 snugly. As beading line 26 passes through wiper 60, excess emollient is removed and falls back into bath 56.

After wiping, beading line 26 passes over appropriate guide rollers, such as 64 and 66, to drive-roller or pulley 68 which is driven directly by shaft 70 of motor 40. Idler roller 72 gives the desired angle of wrap of beading line 26 around drive-roller 68. Spooling roller 74 guides beading line 26 to the proper position on pick-up spool 50.

Pulley 76 is secured to shaft 70 and may have a diameter equal to that of drive-roller 68. In any event, the relative diameter of pulley 76 and pulley 78, the latter being secured to pick-up spool 50, is such that the linear speed of beading line 26 over spool 50 exceeds, or tends to exceed, the linear speed of beading line 26 over drive-roller 68, as a result of which tension is maintained in beading line 26 as it is wound on spool 50. Spool roller 74 may be caused to oscillate along a line parallel to the axis of spool 50, a technique which is well known and need not be described here.

In FIG. 3, forming die 18 has an opening 22 therein which is circular in cross-section throughout its length but has a slowly tapered entrance region 80, a right-circular cylindrical landing region 82 and a sharply tapered exit region 84. The walls of the entrance and landing regions must have polish-smooth surfaces so as to prevent abrasion on the surface of lacing 14 as it is formed into beading line 26. Further, the length of landing region 82 should be less than 1/16 inch and greater than 1/64 inch. In this range the required shape "memory" of the leather beading line is achieved with minimum breakage in the system. A greater landing region length causes unnecessary friction and breakage in the processing and a lesser landing region length is likely to cause cutting instead of forming of the leather lacing 14. Opening 43 in die 41 is shaped similarly to opening 22 in die 18 except that its minimum diameter is less.

As has been indicated, forming dies of successively lesser internal diameter may be used sequentially to achieve the final, desired beading line diameter. For example, the landing region of die 18 may have a diameter of 0.052 inches whereas the landing region of die 41 may have a diameter of 0.047 inches to yield a beading line of approximately a 3/64 inches diameter. More dies may be used to achieve the desired diameter in smaller steps and with less tension.

While a particular embodiment of my invention has been shown and described, variations thereof will be apparent to those skilled in the art and it is intended that all such variations shall be included within the scope of the appended claims.

I claim:

1. The process for forming, from leather lacing of rectangular cross-section, beading line of smooth and uniform surface and consistent circular cross-section, including the steps of:

soaking the lacing in a liquid which is compatible with the lacing;

drawing the lacing through at least one forming die having an opening of predetermined shape and dimensions to form a leather beading line;

drying the beading line; and applying an emollient to the beading line.

2. The process according to claim 1 including, in addition, the step of wiping excess emollient from the surface of the beading line.

3. The process according to claim 2 which includes the additional steps of spooling the wiped beading line and aging the spooled beading line.

4. The process according to claim 1 in which the compatible liquid is water.

5. The process according to claim 4 in which the emollient is a natural oil.

6. The process according to claim 4 in which the emollient is linseed oil.

7. The process according to claim 1 in which the leather lacing is from calf's hide, the compatible liquid is water, the emollient is linseed oil and which process includes, in addition, the steps of wiping excess emollient from the surface of the beading line, spooling the wiped beading line and aging the spooled beading line for approximately 24 hours.

8. Apparatus for the forming of beading line, having a circular cross-section of consistent diameter, from leather lacing of rectangular cross-section which includes:

a drive motor;

a drive-roller driven by said drive motor and adapted to move said beading line over its surface;

a pick-up spool driven by said drive motor and adapted to receive and store said beading line moved by said drive roller;

a spindle for receiving a feed reel carrying said leather lacing of rectangular cross-section;

at least one forming die having an opening of circular cross-section therein for receiving said lacing from said feed reel and forming said lacing into beading line of circular cross-section in response to the movement of said lacing through said opening by said drive-roller;

emollient application means positioned in the path of said lacing and beading line between said at least one forming die and said pick-up spool for the application of an emollient to said beading line; and, drying means positioned along said path of said lacing and beading line between said at least one forming die and said emollient application means for removing moisture from said beading line prior to the application of said emollient.

9. Apparatus according to claim 8 which includes, in addition, wiping means interposed between said emollient application means and said pick-up spool in the path of said beading line for removing excess emollient from the surface of said beading line prior to the storing of said beading line on said pick-up spool.

10. Apparatus according to claim 8 in which said opening in said at least one forming die has a slowly tapered entrance region, a right-circular cylindrical landing region and a sharply tapered exit region.

11. Apparatus according to claim 10 in which said landing region has a length less than 1/16 inch.

12. Leather beading line made according to the process of claim 1.

13. Leather beading line made according to the process of claim 2.

14. Leather beading line made according to the process of claim 3.

* * * * *